United States Patent [19]

Fujimura

[11] Patent Number: 4,973,879

[45] Date of Patent: Nov. 27, 1990

[54] SHADOW MASK TYPE COLOR CRT

[75] Inventor: Takeo Fujimura, Nagaokakyo, Japan

[73] Assignee: Mitsubishi Denki Kabushiki Kaisha, Tokyo, Japan

[21] Appl. No.: 412,224

[22] Filed: Sep. 25, 1989

[30] Foreign Application Priority Data

Jan. 27, 1989 [JP] Japan ..... 1-18410

[51] Int. Cl.[5] ..... H01J 29/07

[52] U.S. Cl. ..... 313/403

[58] Field of Search ..... 313/402, 403

[56] References Cited

U.S. PATENT DOCUMENTS

| | | | |
|---|---|---|---|
| 3,766,419 | 1/1973 | Barbin | 313/92 B |
| 4,210,842 | 7/1980 | Nakayama et al. | 313/403 |
| 4,326,147 | 4/1982 | Nakayama et al. | 313/403 |
| 4,741,425 | 6/1988 | Barten | 313/403 |
| 4,766,341 | 8/1988 | Nakamura | 313/402 |

*Primary Examiner*—Sandra L. O'Shea

[57] ABSTRACT

A shadow mask type color CRT has a plurality of electron beam holes and a plurality of bridges for dividing the holes in the axial direction thereof. The electron beam projected from an electron gun passes the electron beam holes and stimulates the fluorescent screen behind the holes so as to cause the fluorescent screen to emit light. By the arrangement of the bridges in such a manner as to deviate the position of each bridge by the distance U from the intersection of an imaginary lattice, the defect such as fringes including a Moire on the screen caused by the regular arrangement of the bridges in the prior art is eliminated. The distance U is determined by a probability distribution function Q(U) which satisfies Moire regulating conditions. The shadow mask type CRT is used as a CRT commonly for two different systems using a different number of scanning lines.

19 Claims, 6 Drawing Sheets

SHADOW MASK TYPE COLOR CRT

BACKGROUND OF THE INVENTION

The present invention relates to a shadow mask type color CRT having a shadow mask.

A shadow mask type color CRT is composed of a fluorescent screen having countless fluorescent stripes arranged in parallel to each other at regular intervals, an electron gun disposed opposite to the fluorescent screen and a shadow mask having countless electron beam holes (hereinunder referred to simply as "holes") disposed with a predetermined positional relationship with the fluorescent stripes. The shadow mask is disposed in the interior of the CRT substantially in parallel to and in proximity to the fluorescent screen.

The current density (namely, stimulation density) in a certain section of the electron beam projected from the electron gun is not always constant and ordinarily has a Gaussian distribution or a density distribution approximate thereto. The electron beam is deflected by a deflection yoke which is attached to the outside of the tube of the color CRT in the vicinity of the gunpoint of the electron gun and then enters the shadow, mask in such a manner as to form scanning lines perpendicular to the fluorescent stripes at regular intervals. A part of the electron beam passes through the holes provided in the shadow mask and enters the fluorescent screen so as to selectively cause the fluorescent stripes to emit light.

Each of the holes provided in the shadow mask has a rectangular shape having a substantially constant length and is divided by a bridge having a substantially constant width in the direction perpendicular to the scanning line. These holes are arranged in alignment substantially in parallel to the fluorescent stripes in correspondence therewith, thereby constituting a hole group for each line. In each of the hole groups, bridges are provided so as to make the relative spaces $P_S$ of the holes substantially constant in the respective lines.

The bridges are provided at the intersections of the axes of the hole groups and a plurality of parallel lines which are perpendicular to the lines of the hole groups. That is, on the shadow mask, a plurality of hole groups are provided in lines and a plurality of parallel lines are provided perpendicularly to the axes of these holes, as described above. These axes and the parallel lines constitute an imaginary lattice on the shadow mask, and the bridges are disposed at the intersections of the imaginary lattice. If the parallel lines are set at a predetermined pitch $P_A = P_S/2$, a bridge is first disposed at an intersection and subsequent bridges are disposed in series at intersections diagonal to the precedent intersection. In this case, with respect to the adjacent holes, the bridges are disposed at a pitch of $P_A$.

In this way, all the bridges are regularly arranged on the shadow mask with a periodicity in the axial direction of the holes. In this state, if the scanning lines formed by the electron beam are arranged at regular intervals on the shadow mask, the amount of electron beam which passes each hole of the shadow mask is different in holes. Thus the amounts of light emission of the fluorescent substances corresponding to the respective holes are different from each other. On the whole, interference fringes appear at a pitch which is larger than either of the pitch of the holes $P_S$ in the axial direction and the pitch $P_B$ of the scanning lines. These interference fringes are called a Moire, which sometimes produces extreme nonuniformity in the period or the intensity of light emission, thereby greatly impairing the picture quality. Generation of a Moire will be slightly analytically explained hereinunder.

The distribution of stimulation density on a fluorescent screen having no shadow mask due to the electron beam which enters the fluorescent screen will first be considered. If the point at which the electron beam enters the fluorescent screen is called a stimulation point, the stimulation points linearly move in one direction (this direction will be referred to as "direction of X") due to the scanning of the electron beam, thereby constituting a scanning line. The scanning lines are arranged at regular intervals in the direction (this direction will be referred to as "direction of Y") perpendicular to the direction of X, thereby constituting a field. Repetition of these operations forms a picture on the fluorescent screen.

The stimulation density which is to be generated on the fluorescent screen having no shadow mask due to the scanning of the scanning lines is constant for each value of Y in the direction of X if the electron beam current is constant, but has a periodicity in the direction of Y, as shown in FIG. 9. If this periodicity is assumed to be a stimulation density distribution function $T_B(Y)$, $T_B(Y)$ is represented by the following formula [1] obtained by Fourier series expansion:

$$T_B(Y) = B_0 + \sum_{n=1}^{\infty} B_n \cos \frac{2\pi n Y}{P_B} \quad [1]$$

wherein $P_B$ represents the space between adjacent scanning lines which are arranged at regular intervals. It is here assumed that when one scanning line is selected and, the center thereof is determined at $Y=0$ and all the scanning lines have a stimulation density distribution symmetrical with respect to the center lines of the respective extensions. The functions $B_0$, $B_1$. . . are constants calculated from the stimulation density of the section of the stationary electron beam or the like.

FIGS. 10A and 10B are schematic views of the periodic mosaic pattern of the fluorescent screen and the light emitting portion of a conventional shadow mask type color CRT.

A light emitting portion 1 shown in FIG. 10A has a substantially rectangular shape in correspondence with a hole of a shadow mask (not shown). In each line, the light emitting portions 1 are divided by non-light-emitting portions 2 which correspond to the bridges of the shadow mask and are arranged at a regular pitch $P_S$ in the direction of Y.

The positional relationship between the light emitting portion 1 and the non-light-emitting portion 2 is determined substantially by the specification of the hole of the shadow mask provided between the fluorescent screen and the electron gun due to the structure of the color CRT as is well known, This positional relationship is then projected on the fluorescent screen in a slightly enlarged state. Therefore, strictly speaking, the specification of the light emitting portion 1 and the non-light-emitting portion 2 is not the specification of the shadow mask as it is, but it has substantially the same meaning. For convenience sake, the discussion on the shadow mask will be replaced by the discussion on the fluorescent screen hereinunder. In other words, the light emitting portion 1 corresponds to the hole of the shadow mask and the non-light-emitting portion 2 corresponds to the bridge between the holes. The pitch $P_S$ corresponds to the space between the bridges arranged in the direction of Y on the shadow mask.

When the electron beam impinges on the shadow mask surface at a constant electron energy (stimulation density), a part thereof passes through the holes to cause the fluorescent screen to emit light. At this time, the luminance at one point of the fluorescent screen (which substantially correlates to the shadow mask transmittance at the point corresponding to the point on the fluorescent screen) is assumed to be the luminous efficiency of that point of the fluorescent screen. The luminous efficiencies at each value of Y are averaged over the width of X which is sufficiently larger than spaces between the lines of the hole groups of the shadow mask.

The thus-obtained average luminous efficiency $T_A(Y)$ is a periodic function of $\frac{1}{2}$ the space $P_S$, namely $P_A$ between the adjacent bridges in the same line. $T_A(Y)$ is represented by the following formula [2] obtained by Fourier expansion:

$$T_A(Y) = A_0 + \sum_{m=1}^{\infty}\left(A_m\cos\frac{2\pi mY}{P_A} + A_{0m}\sin\frac{2\pi mY}{P_A}\right) \quad [2]$$

wherein the Y ordinate is the same as divided in the formula [1].

The average luminance L(Y) of each point of the fluorescent screen which emits light when the fluorescent screen is stimulated by the electron beam is divided as follows. The luminance at a value of Y averaged over the width of X which is sufficiently larger than space between the lines of the hole groups of the shadow mask is assumed to be an average luminance at the value of Y and is represented by L(Y). L(Y) is represented by the product of the stimulation density distribution $T_B(Y)$ on the fluorescent screen provided with no shadow mask, which is represented by the formula [1] and the average luminous efficiency $T_A(Y)$ represented by the formula [2]. That is, $$L(Y) = T_A(Y) \times T_B(Y) = \quad [3]$$

$$\left\{A_0 + \sum_{m=1}^{\infty}\left(A_m\cos\frac{2\pi mY}{P_A} + A_{0m}\sin\frac{2\pi mY}{P_A}\right)\right\}\times$$

$$\left\{B_0 + \sum_{n=1}^{\infty} B_n\cos\frac{2\pi nY}{P_B}\right\} = A_0B_0 +$$

$$B_0\sum_{m=1}^{\infty}\left(A_m\cos\frac{2\pi mY}{P_A} + A_{0m}\sin\frac{2\pi mY}{P_A}\right) +$$

$$A_0\sum_{n=1}^{\infty} B_n\cos\frac{2\pi nY}{P_B} +$$

$$\sum_{n=1}^{\infty}\sum_{m=1}^{\infty}\left(A_m\cos\frac{2\pi mY}{P_A} + A_{0m}\sin\frac{2\pi mY}{P_A}\right)\times$$

$$\left(B_n\cos\frac{2\pi nY}{P_B}\right)$$

In the formula [3], the first term represents the average luminance of the fluorescent; the second term the distribution of the light emitting portions of the fluorescent screen, namely, the pattern of the light emission itself depending upon the distribution of the holes of the shadow mask; and the third term represents the pattern of the scanning lines itself.

The fourth term can be converted into the following formula:

$$\sum^{n}\sum^{m}\left[\frac{A_mB_n}{2}\left\{\cos 2\pi Y\left(\frac{m}{P_A} + \frac{n}{P_B}\right) + \cos 2\pi Y\left(\frac{m}{P_A} - \frac{n}{P_B}\right) + \frac{A_{0m}B_n}{2}\left\{\sin 2\pi Y\left(\frac{m}{P_A} + \frac{n}{P_B}\right)\right\} + \sin 2\pi Y\left(\frac{m}{P_A} - \frac{n}{P_B}\right)\right\}\right] \quad [4]$$

The two periodical function terms containing $$\left(\frac{m}{P_A} + \frac{n}{P_B}\right)$$

in the formula [4], which are functions of the space period (pitch) smaller than either of the pattern of the distribution of the holes of the shadow mask and the pattern of the scanning lines, produce no problem. However the two periodical function terms containing $$\left(\frac{m}{P_A} - \frac{n}{P_B}\right),$$

which are periodic functions involving a possibility of becoming a very large pitch, produce a large stripe pattern visual with the naked eye and extending in the direction of X depending upon the pitch and the amplitude, is what is called a Moire, thereby making the screen very indistinct. Although in the formulas [2] and [3], $T_A(Y)$ and L(Y) are explained to be average values in a comparatively large area of X, two lines of hole groups are actually sufficient for considering the average value in a shadow mask mainly hitherto, as is clear from FIG. 9. The same stimulated state is repeated in the direction of X at intervals of two lines. Thus another stripe pattern extending in the direction of X is revealed.

The term producing a Moire in the formula [4] can be converted as follows:

$$\sum^{n}\sum^{m}\left\{\frac{A_mB_n}{2}\cos 2\pi Y\left(\frac{m}{P_A} - \frac{n}{P_B}\right) + \frac{A_{0m}B_n}{2}\sin 2\pi Y\left(\frac{m}{P_A} - \frac{n}{P_B}\right)\right\} = \quad [5]$$

$$\sum\sum\frac{\alpha_mB_n}{2}\cos\left\{2\pi Y\left(\frac{m}{P_A} - \frac{n}{P_B}\right) - \phi_m\right\} =$$

-continued $$\Sigma\,\Sigma\,\frac{\alpha_m B_n}{2}\cos\left\{2\pi Y\frac{1}{\dfrac{P_A P_B}{mP_B - nP_A}} - \phi_m\right\}$$

wherein $$\alpha_m = (A_m^2 + A_{0m}^2)^{\frac{1}{2}} \qquad [6]$$

$$\tan\phi_m = \frac{A_{0m}}{A_m}$$

That is, the amplitude of the intensity of light is $\alpha_m B_n/2$ and the pitch is $P_A P_B/(mP_B - nP_A)$ [7]

This pattern is different depending upon the values of m and n, and when (m, n) is determined, the pattern is also determined. It is now assumed that the Moire corresponding to a certain pair of (m, n) is a Moire of the mode (m, n).

The values $\alpha_m$ and $B_n$ generally matter in the range of $m = 1$ to 5 and $n = 1$ to 5. However, since the values $\alpha_m$ and Bn generally decrease as the values m and n increase, consideration of all combinations of m and n in the range of $m+n \leqq 6$ is sufficient. In other words, a general shadow mask type color CRT must be so designed as to have unobtrusive Moires of these modes.

In order to so design a color CRT as to have an unobtrusive Moire, two important measures may be considered. However they respectively have the following problems.

A first measure is to set the space between the bridges of the shadow mask with respect to the non-light-emitting portions in FIGS. 10A and 10B so as to make the pitch of a Moire as small and inconspicuous as possible. More specifically, the pitch of a Moire is represented by $P_A P_B/(mP_B - nP_A)$, so that the space $P_A$ between the bridges namely, $P_S$ is determined so as not to have a very large value of the Moire pitch in the above-described range of m and n. In other words, it is determined so as to preclude a possibility of holding $mP_B = nP_A$ even approximately.

In an ordinary shadow mask type color CRT, the space $P_B$ between the scanning lines is generally provided as an operational condition. Therefore, $P_A$, namely, the space between the bridges of the shadow mask, is appropriately selected with respect to the given $P_B$ so that the Moire of any mode does not have a conspicuously large pitch.

This method is described at some length, for example, by A. M. Morrell and others on pp. 50 to 62 of "Color Television Picture Tubes" (Academic Press Inc. New York and London, 1974).

However, there is a limitation in the effectiveness of a method of reducing the pitch of a Moire as much as possible by appropriately selecting the pitch of the bridge in the direction of Y.

For example, strictly speaking, the spaces $P_B$ between the scanning lines of a general color CRT are not constant and vary with a certain range by a slight variation of a controlling state or a supply voltage.

It is also required to make the Moire unobtrusive even when the CRT is used in different systems, for example, of NTSC and PAL in which the number of scanning lines are 525 and 625, respectively. If the $P_A$ is selected so as to reduce the pitch of a Moire of a specific mode to an extent which makes it unobtrusive, the $P_A$ may be disadvantageous for a pitch of a Moire of at least another mode.

Generally, when the pitch $P_A$ of the bridges in the direction of Y is selected, the range of the $P_A$ with respect to the given pitch $P_B$ of the scanning lines is roughly determined. Further, the point at which the pitch of the Moire of a mode which matters when a comparatively large value is set as $P_A$ equals the pitch of the Moire of a mode which matters when a comparatively small value is set as $P_A$ is assumed to be the value of compromise of $P_A$. This compromise, however, is often incomplete. Therefore, and when the characteristic, in the case in which the space $P_B$ between the scanning lines is changed, taken into consideration, the final characteristic is generally very unsatisfactory.

A second measure for designing a color CRT so as to have an unobtrusive Moire is to reduce om in the formula [5] to a negligibly small value, $\alpha_m$ one of the causes for increasing the amplitude $$\frac{\alpha_m B_n}{2}$$

of the intensity of light of a Moire. $\alpha_m$ in the formula [5]is determined by $A_m$ and $A_{0m}$ in the formula [2]. Since both $A_m$ and $A_{0m}$ represent the phase relationship of the arrangement of the holes and the arrangement of the scanning lines on the shadow mask, the substantial problem is common.

In other words, $A_m$ and $A_{0m}$ represent the size of the m-th higher harmonic in the periodic function which represents the average luminous efficiency in the direction of Y determined by the arrangement of the holes on the shadow mask, namely, in a certain range of the direction of X, and are represented by $\alpha_m$.

As the means for reducing $\alpha_m$, some methods have conventionally been known.

For example, as shown in Japanese Patent Publication No. 32596/1973 and Japanese Patent Laid-Open No. 33473/1977, the space between the bridges provided between the holes on the shadow mask is made constant in each line. The deviation $P_A$ from the space between the bridges in the adjacent line is set at a value other than $P_S/2$ as shown in FIGS. 10A. Further the same pattern is repeated in the direction of X at intervals of two to several lines. The amount of deviation may consist of a plurality of repeating values. According to this method, it is indeed possible to reduce a specific $\alpha m$ to zero, but patterns slightly different from each other are repeated in the direction of X at intervals of two to several lines of hole groups on the shadow mask, or at least patterns assuming the same state in each two to several lines are repeated in the direction of Y at every pitch PS. In other words, a certain pattern of a certain size is periodically repeated, which are perceived by a visually sensitive person as an offensive to the eye.

Another method is a method of arranging the bridges at random in consideration that the regular arrangement of the bridges on the shadow mask produces a Moire. If the bridges are arranged at random, the formula [2] does not hold, thereby preventing a Moire.

This method is disclosed in, for example, Japanese Patent Laid-Open Nos. 744/1975, 40072/1976 and 107063/1976. However, it is necessary in the random arrangement of bridges that the space between the bridges in one line does not exceed a predetermined. This is because if it is larger than the predetermined value, in other words, one hole of a shadow mask has a larger length than the predetermined value, then is a problem in the strength of the shadow mask.

In addition, if the space between the bridges of the holes on a shadow mask is too small, the picture on the screen at that portion becomes very dark. Further, if the positions of the bridges in the adjacent lines of the hole groups are very close, namely, take very close Y coordinate values the picture on the screen at that portion becomes very dark. Therefore since the bridge density becomes low in the vicinity thereof, a problem in the strength produces on the shadow mask.

Therefore, in the above-described known examples, some restrictions are imposed in the random arrangement of bridges in order to eliminate the above-described defects. As a result the completely random arrangement is impossible. The random arrangement of bridges is generally accompanied by nonuniformity due to noise, namely, an irregular luminance distribution which is visually observed and is generally called pepper and salt, snow or freckle. The random arrangement of bridges with the above-described restriction imposed has a smaller Moire removing effect in proportion to the noise caused by the non-uniform position of the bridges, and consequently has some problems in practical use.

SUMMARY OF THE INVENTION

Accordingly, it is an object of the present invention to eliminate the above-described problems in the prior art and to provide a shadow mask type color CRT having a novel arrangement of bridges, which is capable of making a Moire of a specific mode unobtrusive, thereby reducing the value of $\alpha_m$ with respect to a specific value of m.

To achieve this aim, in the present invention, a bridge is provided in the vicinity of a point apart from an intersection of the imaginary lattice by the distance U in the axial direction of the hole. The distance U, which is one of the stochastic events with no dependence of another, is determined stochastically at each intersection and separately from another. The stochastic events belongs to the set of the stochastic phenomena having a probability distribution function for the respective intersection. The distance U also satisfies the following conditions:

$$Q(U)=Q_{12}(U)+Q_{34}(U)$$

wherein $Q_{12}(U)$, $Q_{34}(U)$ are symmetrical with respect to $U=0$ $$Q_{12}(U)=Q_1(U)+Q_2(U),$$

wherein $Q_1(U)$, $Q_2(U)$ are symmetrical with respect to $$U = -\frac{P_A}{4m}$$

$$Q_{34}(U)=Q_3(U)+Q_4(U),$$

wherein $Q_3(U)$, $Q_4(U)$ are symmetrical with respect to $$U = \frac{P_A}{4m}$$

$$\text{In the case of } U < -\frac{P_A}{2} \text{ or } U > \frac{P_A}{2},\ Q(U) = 0 \qquad \text{(D)}$$

In the case of $U<-P_A/2$ or $U>P_A/2$, $Q(U)=0$

In (A) to (D), m represents an integer of 1 to 5, and $P_A$ represents a pitch of parallel lines which are perpendicular to the axes of holes and constitute the imaginary lattice.

If the probability distribution function Q(U) satisfies the above-described conditions (A) to (D) and the positions U of the bridges are determined by the functions Q(U), as described above, the following advantageous are brought about:

(1) The frequency in appearance of the position U is regulated by the probability distribution functions Q(U). As a result, the spectrum ($A_m$, $A_{0m}$ in the formula [2]) in the axial direction of the holes (corresponding to the direction of Y in the prior art) of the average luminous efficiency $T_A(Y)$ in a sufficiently wide range of the direction of scanning (corresponding to the direction of X in the prior art) becomes. Thus the amplitude ($\alpha m$ in the formula [5]) becomes zero. In this way, the Moire at a desired m is greatly suppressed.

(2) The fringes in the direction of scanning (direction of X) caused by the arrangement of the holes at a regular pitch are suppressed by the deviation arrangement of the holes due to the positions U.

(3) By satisfying the condition (D), the reduction in the strength of the shadow mask which would otherwise be caused by the deviation arrangement is prevented. The Moire and the fringes in the direction of scanning are therefore suppressed while maintaining the strength of the shadow mask.

The intersections on which the bridges are arranged are selected in accordance with the arrangement of the fluorescent stripes. For example, one intersection is first determined and other intersections in the diagonal positions in the lattice are subsequently selected.

As the probability distribution functions Q(U), both (1) a continuous probability density distribution function with respect to the position U, and (2) a discrete probability distribution function with respect to the position U are usable.

In accordance with the condition D), the following formula holds with respect to (1), $$\int_{-\frac{P_A}{2}}^{\frac{P_A}{2}} Q(U)dU = 1$$

and the following formula holds with respect to (2): for all U $$\sum_{\text{for all } U} Q(U) = 1$$

It is possible to obtain the expected effect by selecting either of the functions (1) and (2).

In more detail, various probability distribution functions Q(U) as follows may be adopted for (1):

PA $$\text{In the range of } -\frac{P_A}{2m} \leqq U \leqq \frac{P_A}{2m}, \qquad \text{(1a)}$$

uniform distribution $$\text{At } U = -\frac{P_A}{2m},\ U = 0 \text{ and } U = \frac{P_A}{2m},\ Q(U) = 0, \text{ and} \qquad \text{(1b)}$$

-continued $$Q(U) \text{ has a peak at } U = -\frac{P_A}{4m} \text{ and } U = \frac{P_A}{4m}.$$

(two-peak triangular distribution)

$$\text{In the range of } -\frac{P_A}{4m} \leqq U \leqq \frac{P_A}{4m}, \tag{1c}$$

uniform distribution and in the range of $$-\frac{3P_A}{4m} \leqq U < -\frac{P_a}{4m}, \text{ or } \frac{P_A}{4m} < U \leqq \frac{3P_A}{4m},$$

constant slope distribution. (trapezoidal distribution)

Various probability distribution functions Q(U) as follows may be adopted for (2):

$$\text{At } U = -\frac{P_A}{4m} \text{ and } U = \frac{P_A}{4m}, \tag{2a}$$

$Q(U)$ takes the same value other than zero.

$$\text{At } U = -\frac{3P_A}{8m}, U = -\frac{P_A}{8m}, U = \frac{P_A}{8m} \text{ and } \tag{2b}$$

$\frac{3P_A}{8m}$, $Q(U)$ takes the same value other than zero.

These functions Q(U) (1*a*) to (1*c*), (2*a*) and (2*b*) can bring out the characteristic advantages of the present invention. It goes without saying that the probability distribution functions Q(U) having other wave forms can also be adopted so long as they satisfy the conditions (A) to (D).

The above and other objects, features and advantages of the present invention will become clear from the following description of the preferred embodiments thereof, taken in conjunction with the accompanying drawings.

BRIEF DESCRIPTION OF THE DRAWINGS

FIGS. 3A to 3D are distribution diagrams for explaining the operation of removing a Moire in the first embodiment, wherein FIG. 3A is a distribution diagram of the average luminous efficiency $T_A(Y)$ on the assumption of the existence of a shadow mask;

FIG. 3B is a distribution diagram of the average luminous efficiency $T_0(Y)$ on the assumption of the absence of a shadow mask;

FIG. 3C is a distribution diagram of the reductions $T_1(Y)$, $T_2(Y)$, $T_3(Y)$ and $T_4(Y)$ in the average luminous efficiency produced by providing a shadow mask; and FIG. 3D is a distribution diagram of the cosine component of the average luminous efficiency $T_A(Y)$ at $m=3$ and $P_A=0.66$;

Figure 7A:
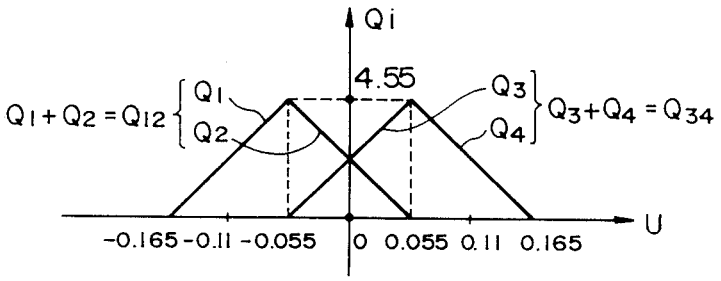
Figure 7B:
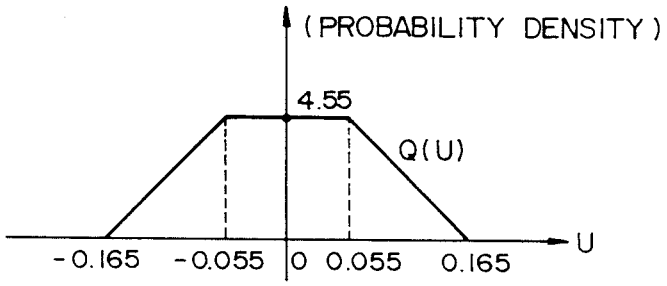
Figure 8:
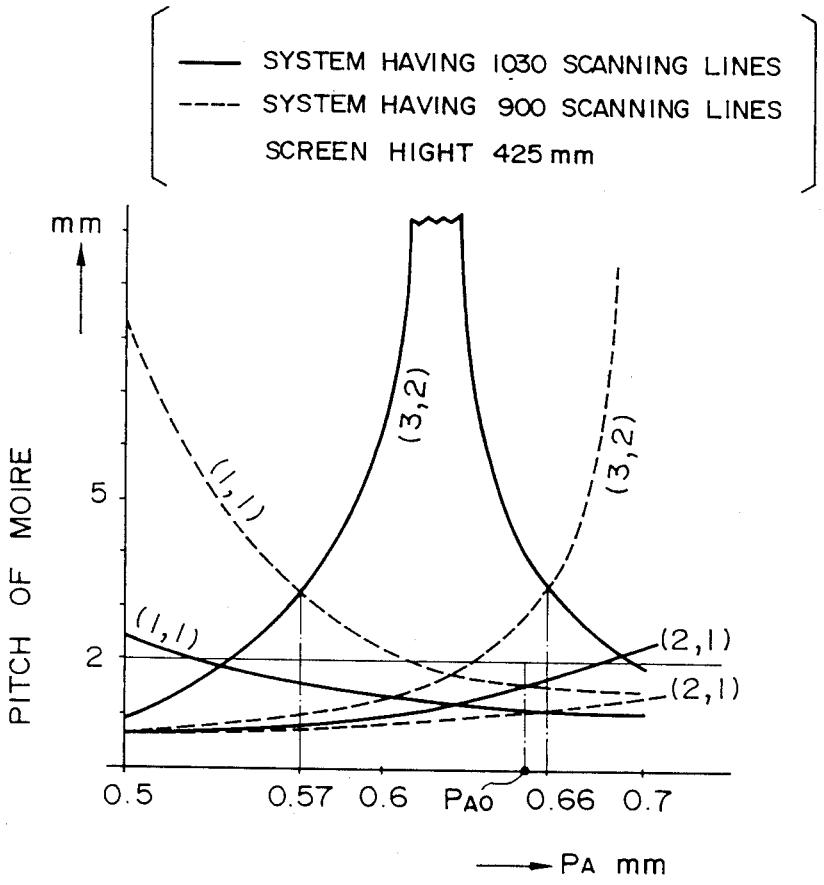
Figure 9:
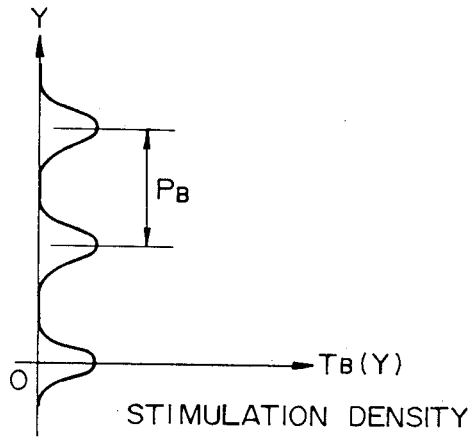
FIG. 9 PRIOR ART
Figure 10A:
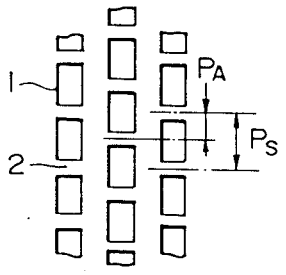
FIG. 10A PRIOR ART
Figure 10B:
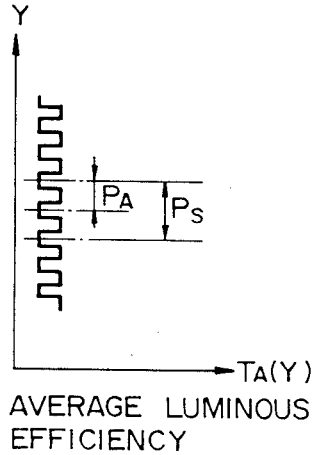
FIG. 10B PRIOR ART

at the same height, as in the third embodiment;

FIGS. 7A and 7B are distribution diagrams of the probability distribution function Q(U) used in a fifth embodiment of the present invention, wherein FIG. 7A is a distribution diagram of the components $Q_1$, $Q_2$, $Q_3$ and $Q_4$ of the probability distribution function Q(U); and FIG. 7B is a distribution diagram of the probability distribution function Q(U) obtained by synthesizing these components, the probability distribution function Q(U) being a function of trapezoidal distribution;

FIG. 8 is a design chart for preventing a Moire, showing the pitch of a Moire in the shadow mask type color CRT which corresponds to the systems having two different number of scanning, lines;

FIG. 9 is a distribution diagram of the stimulation density distribution function $T_B(Y)$ in the case where there is no shadow mask; and FIGS. 10A and 10B explain the light emitting operation of the fluorescent screen of a shadow mask type color CRT of a conventional bridge arrangement, wherein FIG. 10A is a distribution diagram of light emitting portion and non-light-emitting portion, and FIG. 10B is a distribution diagram of the average luminous efficiency $T_A(Y)$.

DESCRIPTION OF THE PREFERRED EMBODIMENTS

Embodiments of the present invention will be explained hereinunder with reference to a shadow mask type color CRT with the fluorescent screen having an effective length of 425 mm in the direction of Y of the screen, which is used for two systems having 1030 scanning lines in the effective length, namely, the space $P_B$ between the scanning being 0.413 mm, and having 900 scanning lines, namely, the space $P_B$ between the scanning lines being 0.472 mm as an example.

It is now assumed that the average space $P_S$ between the bridges in one line of hole groups is intended to be set at about 1.2 mm in the light of luminance and the strength of the shadow mask. Properly speaking, these numerical values on the shadow mask should first be discussed on the fluorescent. Further, they thereafter must be calculated in terms of the values on the actual shadow mask by appropriate reduction. However, the numerical values of the following terms in the shadow mask are hereinunder assumed to use the values on the fluorescent screen as they are.

Since the average space $P_S$ between the bridges in one line of hole group is about 1.2 mm, if a conventional shadow mask structure shown in FIG. 10 is adopted, $P_A=\frac{1}{2}P_S$, in other words, $P_A$ is about 0.6 mm.

If the spatial period (pitch) of a Moire at each m, n in the range of $m+n \leqq 6$ and at $P_A$ pf $0.6\pm0.1$ m is calculated by the method described in relation to the formula [5], the results shown in FIG. 8 are obtained.

The solid line corresponds to the system having 1,030 scanning lines and the broken line to the system having 900 scanning lines. If the pitch of a Moire is large, there is a problem. However since the pitches of Moires except those of modes (m, n)=(1, 1), (2, 1) and (3, 2) shown in FIG. 8 are sufficiently small, for those not shown FIG. 8, explanation thereof will be omitted.

As is clear from FIG. 8, with respect to the systems having two kinds of scanning lines, it is when $P_A=0.57$ mm and $P_A=0.66$ mm that the Moire pitch becomes minimum in the ranges of mode and $P_A$ shown in FIG. 8. At this time the modes bringing out problems when $P_A=0.57$ mm are the mode (1, 1) in the system having 900 scanning lines and mode (3, 2) in the system having 1,030 scanning lines, and when $P_A=0.66$ mm the mode (3, 2) matters in both systems.

The Moire of the mode (1, 1) has a very large luminous amplitude ($\alpha$1, B1) and is difficult to remove. If $P_A=0.66$ mm is adopted, the Moire pitch is about 3.3 mm and cannot be reduced any further. Even if the space between the scanning lines initially takes the preset value, if it varies for some reason or other, the Moire pitch rapidly increases. This thereby makes the screen very indistinct.

In an ordinary color CRT, the Moire pitch is required not to exceed 2 mm. If the tolerable Moire pitch is 2 mm, the mode that matters is only (3, 2) and the other modes have no problem.

Therefore, instead of reducing the Moire pitch of the mode (3, 2) any further, the function $\alpha_3B_2$ in the formula [5], is reduced to a degree that can be expressed by $\alpha_3=0$. This thereby prevents a Moire from being observed as the amplitude of the intensity of luminance irrespective of the pitch of the Moire.

Figure 1:
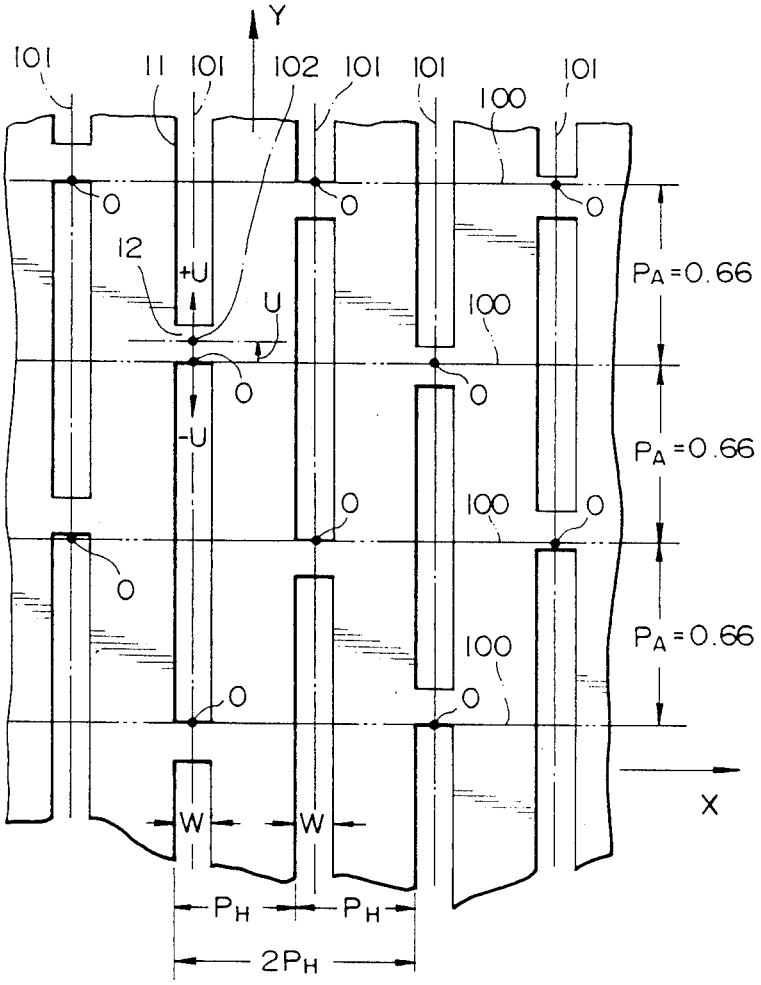
FIG. 1 is a partial plan view of the structure of a first embodiment of a shadow mask type CRT according to the present invention, showing a bridge 12 disposed by a deviation of U which is determined by the probability distribution function Q(U), which is characteristic of the present invention.

FIG. 1 shows the arrangement of holes on a shadow mask in a first embodiment of the present invention.

The hole groups form lines parallel in the direction of Y and parallel line groups 100 are supposed to cover the entire surface of the shadow mask at an interval of 0.66 mm.

Straight line groups 101 (which cover the entire surface of the shadow mask in parallel to the direction of Y) are supposed to pass the centers of the respective hole groups on the shadow mask and an imaginary lattice containing intersection groups of the parallel lines 100 and the straight lines 101 is supposed. A given intersection is first selected, and every other intersection both in the directions of X and Y is subsequently taken out. Many coordinate systems (U coordinate system) in a small range, each of which has the intersection as the origin and the direction of +U as the direction of +Y, are imagined. In FIG. 1, only one coordinate system is shown.

In the U coordinate system, the center 102 of the bridge 12 is disposed at the position U. However, the values of U relative to the respective intersections are not constant and are determined for the respective coordinate systems (origins) as one of the stochastic events independent of the set of the stochastic phenomena having a certain probability distribution function Q(U). If it is assumed that the probability distribution function Q(U) is a probability density function Q(U) for representing the probability of the value of U taking a value in the range of the a specific U and $U+\Delta U$ as $Q(U)\Delta U$, Q(U) has the following characteristics:

(a) Q(U) is the sum of two functions $Q_{12}(U)$ and $Q_{34}(U)$ which are symmetrical to each other with respect to U=0.

(b) $Q_{12}(U)$ is the sum of two functions $Q_1(U)$ and $Q_2(U)$ which are symmetrical to each other with respect to $U=-0.055$. $Q_{34}(U)$ is the sum of two functions $Q_3(U)$ and $Q_4(U)$ which are symmetrical to each other with respect to U=0.055.

The value 0.055 is obtained by multiplying the space 0.66 between the parallel lines 100 by $$\frac{1}{3\times4}$$

(3 corresponds to m=3).

(c) Q(U) includes $U=-0.11$ and $+0.11$, and takes a value other than zero only in this range.

The value 0.11 is obtained by multiplying the space 0.66 between the parallel lines 100 by $$\frac{1}{3\times2}$$

(3 corresponds to m=3).

$$\text{(d)} \quad \int_{-0.11}^{0.11} Q(U)dU = 1$$

Figure 2:
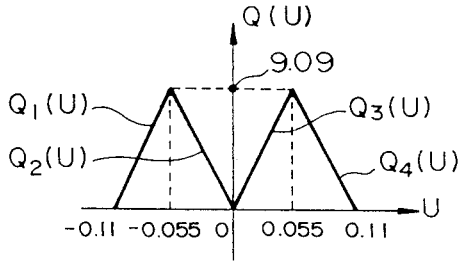
FIG. 2 is a distribution diagram showing the wave form of the probability distribution function Q(U) used in the first embodiment shown in FIG. 1, the probability distribution function Q(U) being a function of a two-peak triangular distribution.

The first embodiment is further characterized in that Q(U) has a shape shown in FIG. 2.

That is, Q(U) has a shape formed by combining the respective points (−0.11, 0), (−0.055, 9.09), (0,0), (0.055, 9.09) and (0.11, 0) by a straight line. The respective intervals of the straight line are assumed to be $Q_1(U)$, $Q_2(U)$, $Q_3(U)$ and $Q_4(U)$, and $Q_1$ to $Q_4$ to be 0 in the other intervals not shown.

Strictly speaking, in order to deny a mathematical contradiction between the symmetry of the joints of the intervals and the continuity of the respective functions at the joints, a slight modification in the definition of the function is necessary at the joints of the intervals. However, since there in no practical influence, it will be omitted in some cases hereinunder.

The description of the intervals, namely, the signs of equality in the closed intervals and the open intervals do not always strictly hold the symmetry which is conditioned by the present invention. However, a modified interpretation which is self-evident from the conditions of the present invention will be appropriately made, if necessary.

According to this structure, A3 and Ao3, namely, $\alpha$3 can take the value of zero.

In the calculation of the average luminous efficiency $T_A(Y)$ in the formula [2], it is necessary to average the luminous efficiencies for each value of Y in a range of X which is sufficiently wider than the space between the lines of hole groups. In this embodiment, however, if the probability, namely, the expected value of the position of the bridge is taken into due consideration, the calculation for the two lines of hole groups, for the width of X represented by $2P_H$ in FIG. 1, is sufficient.

Figures 3A, 3B, 3C, 3D:
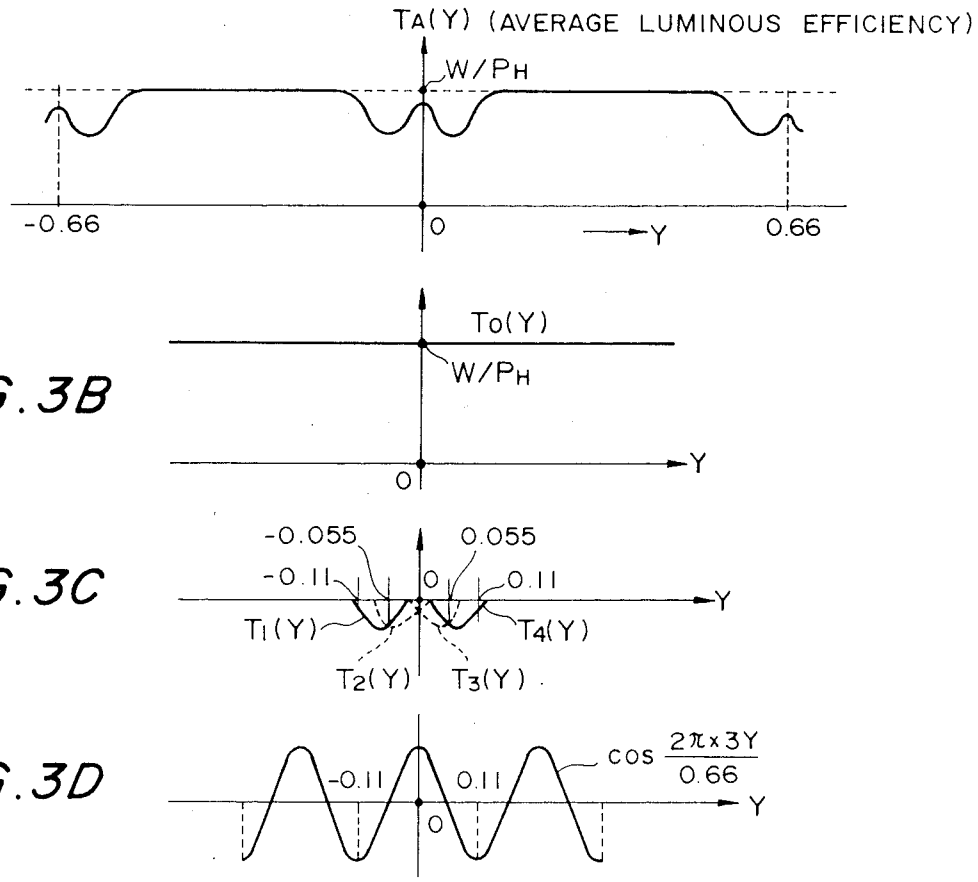

If any given adjacent lines of hole groups are selected and one of the origins is selected as $Y=0$, the average luminous efficiency $T_A(Y)$, namely, the average transmittance of the shadow mask, is obtained in consideration of the expected value of the position of a bridge, as shown in FIG. 3(A).

W represents the width of the hole of a shadow mask in the direction of X. $T_A(Y)$ is represented by $$\frac{W}{P_H}$$

except for the vicinity of $Y=0$ and the vicinity of the point apart from $Y=0$ by the multiples of $\pm 0.66$.

The average luminous efficiency $T_A(Y)$ in the vicinity of $Y=0$ and the vicinity of the point apart from $Y=0$ by the multiples of $\pm 0.66$ (hereinunder the average luminous efficiency only in the vicinity of $Y=0$ will be described as a representative) is calculated from the probability distribution function Q(Y) representing the expected value of the central position of a bridge and the width of the bridge in the direction of Y. However, since this calculation requires a complicated calculation of what is called convolution, the average luminous efficiency $T_A(Y)$ in these regions will be considered graphically hereinunder.

The function in FIG. 3A is a function obtained by superimposing the luminous efficiency locally averaged by a bridge, namely, the reduction in the average transmittance of the shadow mask on $T_0(Y)=W/P_H$ (constant), which is a function obtained on the assumption that there is no bridge 12 on the shadow mask, as shown in FIG. 3B.

The reduction in the average luminous efficiency $T_A(Y)$ is different depending on the location of the central position 102 of the bridge 12. The location of the central position U 102 of the bridge 12 is divided into the following four cases:

(1) $-0.11<U<-0.055$
(2) $-0.055<U<0$
(3) $0<U<0.055$
(4) $0.055<U<0.11$

If the probabilities of the appearance of the bridge in the respective intervals is (1) $T_1(Y)$, (2) $T_2(Y)$, (3) $T_3(Y)$ and (4) $T_4(Y)$ in correspondence with the intervals $Q_1(U)$, $Q_2(U)$, $Q_3(U)$ and $Q_4(U)$ in FIG. 2, these are represented by the graph shown in FIG. 3C.

The reason why $T_1(Y)$, for example, distributes beyond the range of $-0.11<Y<-0.055$ (the range of $Q_1(U)$) is that the bridge 12 has a width in the direction of Y.

According to the characteristics (a) and (b) of the shape of the probability distribution frequency Q(U) which represents the expected value of the position of the bridge, $T_1(Y)$ and $T_4(Y)$, and $T_2(Y)$ and $T_3(Y)$ are respectively symmetrical with respect to $Y=0$, and $T_1(Y)$ and $T_2(Y)$, and $T_3(Y)$ and $T_4(Y)$ are respectively symmetrical with respect to $Y=-0.055$ and $Y=+0.055$.

FIG. 3D shows the graph of cos $$\frac{2\pi \times 3Y}{0.66}.$$

$A_3$ in the formula [2] is obtained from a formula of Fourier expansion such as $$A3 = \frac{1}{0.66} \int_{-0.33}^{+0.33} T_A(Y) \cos \frac{2\pi \times 3Y}{0.66}\, dY \qquad [8]$$

The integration range of $-0.33$ to $+0.33$ is selected in accordance with one period of the periodic function $T_A(Y)$ to simplify explanation. However, it is not always restricted to the above-described range so long as the width is 0.66.

As described above, since $$T_A(Y)=T_0(Y)+T_1(Y)+T_2(Y)+T_3(Y)+T_4(Y) \qquad [9]$$

and as is clear from the conditions (b) and (c), and FIGS. 3C and 3D.

$$\int_{-0.33}^{0.33} T_1(Y) \cos \frac{2\pi \times 3Y}{0.66}\, dY = -\int_{-0.33}^{0.33} T_2(Y) \cos \frac{2\pi \times 3Y}{0.66}\, dY$$

$$\int_{-0.33}^{0.33} T_3(Y) \cos \frac{2\pi \times 3Y}{0.66}\, dY = -\int_{-0.33}^{0.33} T_4(Y) \cos \frac{2\pi \times 3Y}{0.66}\, dY$$

and further $$\int_{-0.33}^{0.33} T_0(Y) \cos \frac{2\pi \times 3Y}{0.66}\, dY = 0$$

Therefore, $A_3 = 0$

Similarly, by using a formula of Fourier expansion, $A_{03}$ is represented as follows:

$$A_{03} = \frac{1}{0.66} \int_{-0.33}^{0.33} T_A(Y) \sin \frac{2\pi \times 3Y}{0.66}\, dY \qquad [10]$$

Thus, it is possible to show that $A_{03}$ is 0 in the same way as $A_3$.

In this case, the terms of integration $T_1(Y)$ and $T_4(Y)$ and $T_2(Y)$ and $T_3(Y)$ cancel each other in accordance with the conditions (a) and (b).

Since $A_3$ and $A_{03}$ are zero, $\alpha_3=0$ from the formula [6]. Consequently, since the Moire does not provide a fluctuation in the amplitude of luminance, there is no problem irrespective of the pitch.

According to this method, the positions of the bridges 12 are stochastically different from each other and in this respect it resembles the positions in the known random arrangement. However, the positions of the bridges 12 in this embodiment are distributed in such a manner as to have a predetermined probability density distribution function so as to remove a Moire of a specific mode, it is possible to efficiently remove the Moire of the mode that matters although the range in which the bridges are provided (moved) is comparatively narrow.

Therefore, some kind of unevenness appearing on the fluorescent screen is reduced and it is possible to improve the picture quality synthetically on the fluorescent screen. This means that it is possible to design a shadow mask type color CRT while laying emphasis on the factors other than a Moire such as the luminance and the strength of the shadow mask, thereby producing a high-efficiency color CRT.

As is clear from the above explanation, this embodiment has the same effect on the average luminous efficiency at a specific value of Y as the CRT having a certain degree of electron beam transmittance other than zero at the portion of the bridge 12, which is effectively widened. In other words, the effect similar to the lowering of the contrast of the bridge 12, which generally assumes a black color, is produced.

In a conventional shadow mask, when the pitch $P_S$ (or corresponding to $P_A$) of the holes in the direction of Y is increased to more than a certain degree, the lines of the bridges 2 look in the form of separated black lines in alignment in the direction of. Thus, the adoption of a $P_S$ (or $P_A$) larger than a predetermined length is impossible. According to this embodiment, however, it is possible to take a larger value than in the prior art by virtue of the above-described contrast lowering effect.

In this embodiment, the position of the origin (Y=0) selected is different from the position used in the formulas [1] and [2], wherein the center of a scanning line is set at Y=0. However, the results obtained clearly have no relation to the location of the origin.

Although the hole opening ratio of the shadow mask in the direction of X, the ratio of the width of the holes to the total width of the light emitting portion in the direction of X is assumed to be $W/P_H$. Further, this hole opening ratio is simply assumed to be usable as the factor for calculating the luminous efficiency of the fluorescent screen. In the actual color CRT, the width of the light emitting portion in the direction of X is often regulated by black non-light-emitting stripes which are called a black matrix. They are provided on the fluorescent screen in order to secure the tolerance for adjustment by regulating the width of the fluorescent stripe rather than the width of the holes of the shadow mask.

In this embodiment, however, since the width of the phosphorus (light emitting portion) in the direction of X merely regulates the value of $T_0(Y)$ in FIG. 3B and has substantially no relation to a Moire, respective modifications are not explained.

In order to calculate the respective positions U of the bridges from the given probability distribution function Q(U), a method of converting random numbers, produced at a regular probability in an appropriate interval for each bridge, into the value of U determined on the basis of Q(U), is adopted. Since the details of this method are almost self-evident, explanation thereof will be omitted here.

The shape of Q(U) for removing the Moire at the mode m=3 when the average $P_A$ is 0.66 mm by making $\alpha_3$ zero is not restricted to that shown in this embodiment but it may be any shape so long as Q(U) satisfies the conditions (a) to (d).

Figure 4:
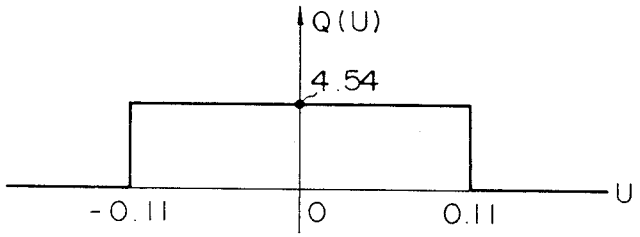
FIG. 4 is a distribution diagram showing the wave form of the probability distribution function Q(U) used in a second embodiment of the present invention, the probability distribution function Q(U) being a function of a uniform distribution.

Therefore, for example, Q(U) having a uniform distribution in the range of $-0.11<U<0.11$, as shown in FIG. 4, is also included in the present invention as a second embodiment. In the case of the second embodiment, the ratio of the center U of the bridge taking a value in the vicinity of the end portions of the interval, namely, −0.11 or +0.11 is increased in comparison with the first embodiments shown in FIG. 2. This means that the possibility of the bridge deviating by the maximum in the specific direction is large and that the possibility of such deviated bridges gathering in a specific small range is large. Therefore, in the respect of the strength of the shadow mask, in particular, the high possibility of producing non-uniform expansion in molding a generally spherical shadow mask, which will cause unfavorable unevenness on the fluorescent screen, the second embodiment cannot always be recommended in comparison with the first embodiment shown in FIG. 2.

In the first and second embodiments, Q(U) is a distribution function of probability density which distributes continuously at least in a certain range of U. However, Q(U) may be a distribution function of probability which discretely takes a value except zero only at certain values of U.

In this case, the condition (d) should be changed as follows:

(d1)

$$\sum_{\text{for all } U} Q(U) = 1,$$

U takes the value between −0.11 and +0.11.

Figure 5:
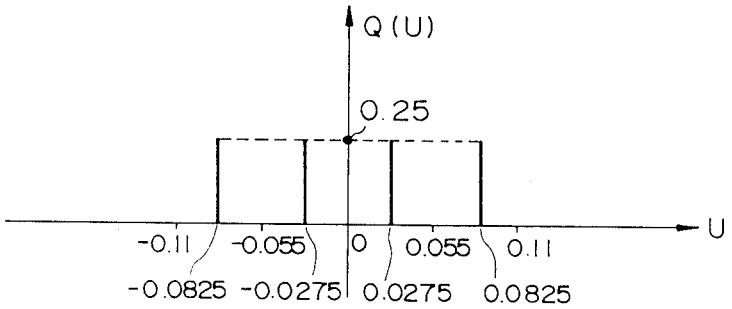
FIG. 5 is a distribution diagram showing the wave form of the probability distribution function Q(U) used in a third embodiment of the present invention, the probability distribution function Q(U) being discrete with respect to the position U of the bridge and rising at the same height with U which is symmetrical with respect to $$U = \pm\frac{P_A}{4m};$$

As an example of such function Q(U), a third embodiment shown in FIG. 5 will be cited. In this embodiment, the probability density distribution function Q(U) has an equal probability of 0.25 (=¼) at four points of U, namely, −0.0825, −0.0275, 0.0275 and 0.0825, which correspond to $Q_1(U)$ to $Q_4(U)$, respectively.

Figure 6:
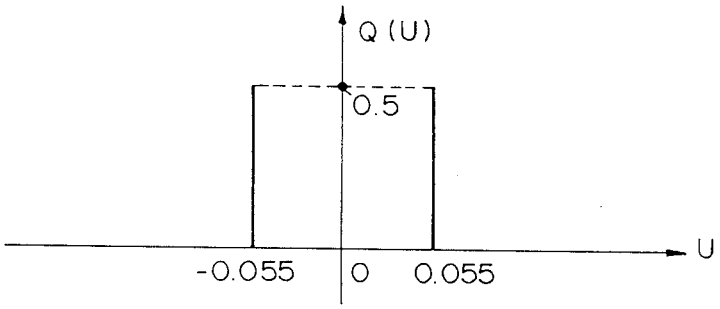
FIG. 6 is a distribution diagram showing the wave form of the probability distribution function Q(U) used in a fourth embodiment of the present invention, the probability distribution function Q(U) being discrete with respect to the position U of the bridge and rising at $$U = \pm\frac{P_A}{4m}$$

In a fourth embodiment, the probability distribution function Q(U) has a probability of 0.5 (=½) at two points of U, namely, −0.055 and 0.055, as shown in FIG. 6.

In other words, an equal probability appears at both of the two values of U. In this case, the two values correspond to $Q_{12}(U)$ and $Q_{34}(U)$, respectively and are regarded as the sum of $Q_1(U)$ and $Q_2(U)$, and $Q_3(U)$ and $Q_4(U)$, respectively, which are equal in amount.

However, the use of the probability distribution function Q(U) having such a small number of points of $U\neq 0$ involves a possibility of some bridges having the same values being adjacent in succession locally on the shadow. That portion appears to have some deficiency, having a regularity. As a result, there sometimes seems to be a stripe defect in the picture on the screen. Thus, the fourth embodiment is not always recommended.

In the embodiments shown in FIGS. 1 to 6, a Moire of the mode m=3 is removed when $P_A$ is 0.66 mm by making $\alpha_3$ zero. The present invention is also applicable to a given $P_A$ and m.

To state this concretely, in FIG. 1, if the regular space between the parallel lines 100 imaginarily provided at regular intervals in the direction of X is $P_H$ and many origins and U coordinate systems are determined as described above, with the center of the bridge being disposed at the position U in each coordinate system, the respective values of U are determined for the respective coordinate systems (origins) as one of the independent stochastic events obtained from the set of the stochastic phenomena having a certain probability distribution function Q(U).

If it is assumed that the probability distribution function is Q(U), Q(U) has the following characteristics:

(A) Q(U) is the sum of two functions $Q_{12}(U)$ and $Q_{34}(U)$ which are symmetrical to each other with respect to U=0.

(B) $Q_{12}(U)$ is the sum of two functions $Q_1(U)$ and $Q_2(U)$ which are symmetrical to each other with respect to $$Q(U) = -\frac{P_A}{4m}.$$

$Q_{34}(U)$ is the sum of two functions $Q_3(U)$ and $Q_4(U)$ which are symmetrical to each other with respect to $$U = \frac{P_A}{4m}.$$

(C1) Q(U) takes a value other than zero only in the range including $$-\frac{P_A}{2m} \text{ and } \frac{P_A}{2m}.$$

(D1) When Q(U) is a distribution function of a probability density, $$\int_{-\frac{P_A}{2m}}^{\frac{P_A}{2m}} Q(U)dU = 1$$

When Q(U) is a discrete probability distribution function which takes a value except zero only at certain values of U, $$\sum^{\text{for all } U} Q(U) = 1$$

in the range including $$-\frac{P_A}{2m} \text{ and } \frac{P_A}{2m}.$$

The range in which Q(U) shown in the conditions (C1) and (D1) takes a value other than zero is not always restricted to the range of $$-\frac{P_A}{2m} \text{ and } \frac{P_A}{2m}$$

for making the value $\alpha m$ zero, as is clear from the explanation given with reference to FIGS. 3A to 3D.

In other words, the necessary conditions for $\alpha 3=0$ are (A) and (B), the range of U in (C1) and (D1) may be wider. However, if the range exceeds $$\pm\frac{P_A}{2},$$

there is a possibility of exceeding the range in which the adjacent bridge distant therefrom by $P_B$ can exist, thereby making the arrangement of bridges unuseful for the shadow mask.

Therefore, the following conditions are more generally used in place of (C1) and (D1).

(C) Q(U) takes a value other than zero only in the range including $$-\frac{P_A}{2} \text{ and } \frac{P_A}{2}.$$

(D) When Q(U) is a distribution function of a probability density $$\int_{-\frac{P_A}{2}}^{\frac{P_A}{2}} Q(U)dU = 1$$

When Q(U) is a discrete probability distribution function which takes a value except zero only at certain values of U, and with respect to all values possible in the range including $$-\frac{P_A}{2} \text{ and } \frac{P_A}{2} \quad \sum^{\text{for all } U} Q(U) = 1$$

As an example of application of these functions to $P_A=0.66$ and m=3, a fifth embodiment is shown in FIGS. 7A and 7B.

FIG. 7A shows $Q_1(U)$ to $Q_4(U)$ and FIG. 7B shows the distribution function Q(U) of probability density determined by the sum thereof.

In this embodiment, the range of the distribution of Q(U) is also wide and the position of the bridge is sometimes greatly deviated from the average position (U=0), so that this embodiment is not always recommended in comparison with the other embodiments. In the fifth embodiment, however, since the same value of U scarcely gathers in a specific range, this embodiment is useful when the value of m is large.

The range of values of U has been described above. In the present invention, it is desirable that the value of U is as close as possible to 0 in order to make the change in the position of the bridge inconspicuous. Thus, this will eliminate the feeling of disorder in the form of noise and to maintain the mechanical strength of the shadow mask. Therefore the conditions (A), (B), (C1) and (D1) are practically the most useful.

Even under the conditions (A), (B), (C1) and (D1), the range of U is different depending upon the value of m. The present invention is recommended most aptly when m=3, 4 or 5 from the point of view of the feeling of disorder and the strength of the shadow mask.

In the above embodiments and general rule, the last conditions (d), (d1), (D1) and (D) mean that one bridge should be provided at one origin and it is not always necessary to regulate the position by using the formula. However, these conditions are useful in the case of obtaining a specific function for concretely calculating U from the random numbers of uniform distribution.

It goes without saying that the probability distribution function Q(U) may have many other shapes.

The shape of the probability distribution function Q(U) are largely divided into two types, namely a shape taken when Q(U) continuously varies with respect to U, in the case of what is called a distribution function of a probability density, and a shape taken when Q(U) takes a value other than zero with respect to the limited number of specific U's, in the case of a discrete probability distribution. However, since both situations are quite the same, as described above, combined use of these shapes is possible under some circumstance. The conditions (D) and (D1) in that case will be easily introduced from a general rule of probability.

It is possible to use different shapes of Q(U) in accordance with the positions on the shadow mask. In this case, the shape of Q(U) must naturally be changed gradually and continuously from one portion to another portion.

In addition, in a special case, it is also possible to set the shape of Q(U) in such a manner as to satisfy the conditions (A) to (D) only at the portion at which the Moire of the shadow mask is the most conspicuous and to set a quite different distribution function in the other portions.

In a general shadow mask, the strength including the uniformity of strength of the peripheral portion is important in order to ensure the molding stability and mechanical shape maintenance. From this viewpoint, it is desirable that the bridges exist only at U=0 in the peripheral portion, namely, the longer side portions and the shorter side portions (the latter being known to be especially important by experience) of a shadow mask, for a general color CRT having a rectangular fluorescent screen.

Accordingly, in the vicinity of the peripheral portion, the condition (B) may be abandoned so as to gradually vary the shape of Q(U) such that a high value is taken only at the point Q(U)=0.

To state this more concretely, the horizontal width of the screen of a color CRT having a screen height of 425 mm is about 755 mm. In this case, the following arrangement of bridges will be cited as an example. The four conditions (A), (B), (C) and (D) are satisfied in the portions except a width of 30 mm from both horizontal end portions, namely, the shorter side portions and at both end portions of 30 mm, wide. Q(U) is gradually varied while abandoning the condition (B) until in the lines of the outermost hole groups, all the bridges are set at the points U=0.

In this structure, the Moire in question appears at both end portions of 30 mm wide. However, since the shape of the function gradually changes, the Moire does not suddenly appear at the end portions. In addition, since both end portions scarcely attract visual attention, the Moire is practically negligible.

The reason why $P_A$ is set at 0.66 in the embodiments including numerical values is that a conventional view for reducing the pitch of the Moire at the mode (3, 2) is taken. However, now that $\alpha_3=0$ is possible, the pitch of the Moire of this mode has theoretically no problem.

It is therefore possible to select a value other than $P_A=0.66$ and to investigate other numerical values. For example, in FIG. 8, the value of $P_{A0}$, which is slightly smaller than 0.66, is clearly preferable. If the color CRT is used only for the system having 1030 scanning lines, it can be said that the smaller $P_A$ is preferred.

As described above, according to the present invention, since the bridges of the hole groups are moved by the amount stochastically determined in a certain range, and the probability distribution function is so selected as to remove the most obtrusive Moire of a specific mode, it is possible to produce a color CRT having a shadow mask which is capable of making the fringes including a change in the spaces between the scanning lines unobtrusive and one which has excellent brightness and strength.

While there has been described what are at present considered to be preferred embodiments of the invention, it will be understood that various modifications may be made thereto, and it is intended that the appended claims cover all such modifications as fall within the true spirit and scope of the invention.

What is claimed is:

1. In a shadow mask type color CRT including a fluorescent screen having a plurality of fluorescent strips arranged in parallel to each other, an electron gun disposed opposite to the fluorescent screen for projecting an electron beams onto said fluorescent screen, and a shadow mask disposed at a predetermined position between the fluoroscent screen and the electron gun, the shadow mask being provided with a plurality of electron beam holes longitudinally parallel to the fluorescent strips with a predetermined positional relationship therewith, the electron beam holes being divided by bridges in the longitudinal direction, the improvement comprising:

said bridges being arranged on the basis of a point selected from intersections of an imaginary lattice composed of a plurality of parallel lines, perpendicular to the longitudinal direction of the electron beam holes at regular intervals $P_A$ and the axes of the electron means;

said bridges being provided at a position deviating from said point in the axial direction of said electron beam holes by the distance U, wherein U is determined to satisfy the following conditions, said position U being determined as one of the stochastic events both belonging to the set of the stochastic phenomena, and having a plurality distribution function Q(U) existing independent of another and separately from another for the respective intersection, said probability distribution function Q(U) satisfying the following conditions, $$Q(U)=Q_{12}(U)+Q_{34}(U), \quad \text{(A)}$$

wherein $Q_{12}(U)$, $Q_{34}(U)$ are symmetrical with respect to U=0

$$Q_{12}(U)=Q_1(U)+Q_2(U), \quad \text{(B)}$$

wherein $Q_1(U)$, $Q_2(U)$ are symmetrical with respect to $$U = -\frac{P_A}{4m}$$

$$Q_{34}(U)=Q_3(U)+Q_4(U),$$

wherein $Q_3(U)$, $Q_4(U)$ are symmetrical with respect to $$U = \frac{P_A}{4m}$$

$$\text{In the case of } U < -\frac{P_A}{2} \text{ or } U > \frac{P_A}{2},\ Q(U) = 0 \quad \text{(D)}$$

wherein n represents an integer of 1 to 5.

2. The shadow mask type color CRT of claim 1, wherein said intersections are selected such that an intersection is first selected and intersections diagonal to the first selected intersection in said lattice are subsequently selected in series.

3. The shadow mask type color CRT of claim 1, wherein said intersections are selected from the intersections being arranged in predetermined area of the shadow mask.

4. The shadow mask type color CRT of claim 1, wherein said probability distribution function Q(U) is a distribution function of probability density which is continuous with respect to said positions U.

5. The shadow mask type color CRT of claim 4, wherein said probability distribution function Q(U) has a uniform distribution in the range of $$-\frac{P_A}{2m} \leqq U \leqq \frac{P_A}{2m}.$$

6. The shadow mask type color CRT of claim 4, wherein said probability distribution function Q(U) has a two-peak triangular distribution in which Q(U) is zero at $$U = -\frac{P_A}{2m},\ U = 0 \text{ and } U = \frac{P_A}{2m},$$

and Q(U) has a peak at $$U = -\frac{P_A}{4m} \text{ and } U = \frac{P_A}{4m}.$$

7. The shadow mask type color CRT of claim 4, wherein said probability distribution function Q(U) has a trapezoidal distribution in which said Q(U) has a uniform distribution in the range of $$-\frac{P_A}{4m} \leqq U \leqq \frac{P_A}{4m},$$

and a constant slope distribution in the range of $$-\frac{3P_A}{4m} \leqq U < -\frac{P_A}{4m} \text{ or } \frac{P_A}{4m} < U \leqq \frac{3P_A}{4m}.$$

8. The shadow mask type color CRT of claim 1, wherein said probability distribution function Q(U) is a probability distribution function which is discrete with respect to said position U.

9. The shadow mask type color CRT of claim 8, wherein said probability distribution function Q(U) has the same value other than zero only at $$U = -\frac{P_A}{4m} \text{ and } U = \frac{P_A}{4m}.$$

10. The shadow mask type color CRT of claim 8, wherein said probability distribution function Q(U) has the same value other than zero only at $$U = -\frac{3P_A}{8m} \text{ and } U = -\frac{P_A}{8m},\ U = \frac{P_A}{8m} \text{ and } U = \frac{3P_A}{8m}.$$

11. The shadow mask type color CRT of claim 2, wherein said probability distribution function Q(U) is a distribution function of probability density which is continuous with respect to said positions U.

12. The shadow mask type color CRT of claim 11, wherein said probability distribution function Q(U) has a uniform distribution in the range of $$-\frac{P_A}{2m} \leqq U \leqq \frac{P_A}{2m}.$$

13. The shadow mask type color CRT of claim 11, wherein said probability distribution function Q(U) has a two-peak triangular distribution in which Q(U) is zero at $$U = -\frac{P_A}{2m},\ U = 0 \text{ and } U = \frac{P_A}{2m},$$

and Q(U) has a peak at $$U = -\frac{P_A}{4m} \text{ and } U = \frac{P_A}{4m}.$$

14. The shadow mask type color CRT of claim 11, wherein said probability distribution function Q(U) has a trapezoidal distribution in- which said Q(U) has a uniform distribution in the range of $$-\frac{P_A}{4m} \leqq U \leqq \frac{P_A}{4m},$$

and a constant slope distribution in the range of $$-\frac{3P_A}{4m} \leqq U < -\frac{P_A}{4m} \text{ or } \frac{P_A}{4m} \leqq U \leqq \frac{3P_A}{4m}.$$

15. The shadow mask type color CRT of claim 2, wherein said probability distribution function Q(U) is a probability distribution function which is discrete with respect to said position U.

16. The shadow mask type color CRT of claim 15, wherein said probability distribution function Q(U) has the same value other than zero only at $$U = -\frac{P_A}{4m} \text{ and } U = \frac{P_A}{4m}.$$

17. The shadow mask type color CRT of claim 15, wherein said probability distribution function Q(U) has the same value other than zero only at $$U = -\frac{3P_A}{8m} \text{ and } U = -\frac{P_A}{8m},\ U = \frac{P_A}{8m} \text{ and } U = \frac{3P_A}{8m}.$$

18. The shadow mask type color CRT of claim 3, wherein said probability distribution function Q(U) is a distribution function of probability density which is continuous with respect to said position U.

19. The shadow mask type color CRT of claim 3, wherein said probability distribution function Q(U) is a probability distribution function which is discrete with respect to said position U.

* * * * *

UNITED STATES PATENT AND TRADEMARK OFFICE

CERTIFICATE OF CORRECTION

PATENT NO. : 4,973,879

DATED : November 27, 1990

INVENTOR(S) : Takeo FUJIMURA

It is certified that error appears in the above-identified patent and that said Letters Patent is hereby corrected as shown below:

In column 3, line 17, after "1/2" insert --of--

In column 7, line 46, following the equation insert --(A)--

In column 7, line 51, following the equation insert --(B)--

In column 7, line 59, following the equation insert --(C)--

In column 8, line 1, delete in its entirety

In column 8, lines 45-49, insert --$\int$-- (integral symbol) before equation

In column 8, lines 50-51, delete "for all U"

In column 12, lines 36-39, after "(d)" and before equation, insert --$\int$--(integral symbol)

In column 13, lines 46-49, change "$<$" to --$\leq$-- in the first occurrence of each line only

UNITED STATES PATENT AND TRADEMARK OFFICE

CERTIFICATE OF CORRECTION

PATENT NO. : 4,973,879

DATED : November 27, 1990

INVENTOR(S) : Takeo FUJIMURA

It is certified that error appears in the above-identified patent and that said Letters Patent is hereby corrected as shown below:

In column 13, line 56, change "$<$" to -- $\leq$ -- in the first occurrence only In column 14, in Equation 8, after "A3 = $\frac{1}{0.66}$ " insert -- $\int$ -- (integral symbol)

In column 14, lines 23-49, before "$\begin{matrix}0.33\\-0.33\end{matrix}$" insert -- $\int$ -- (integral symbol) (in six occurrences)

In column 15, line 66, change "$<$" to -- $\leq$ -- in both occurrences

In column 17, lines 30-34, before equation, insert -- $\int$ -- (integral symbol)

In column 18, lines 11-15, before equation, insert -- $\int$ -- (integral symbol)

In column 20, line 54, after equation insert -- (C) --

Signed and Sealed this

Thirtieth Day of July, 1991

*Attest:*

*Attesting Officer*

HARRY F. MANBECK, JR.

*Commissioner of Patents and Trademarks*